US007151662B2

(12) United States Patent
Tarkoff et al.

(10) Patent No.: US 7,151,662 B2
(45) Date of Patent: Dec. 19, 2006

(54) BRACKET ELEMENT FOR A DISTRIBUTION DEVICE ENCLOSURE

(75) Inventors: Daniel M. Tarkoff, Pittsburgh, PA (US); Dale E. Pfeifer, Washington, PA (US); John M. Liston, West Mifflin, PA (US)

(73) Assignee: Greyfox Systems, Inc., Pittsburgh, PA (US)

( * ) Notice: Subject to any disclaimer, the term of this patent is extended or adjusted under 35 U.S.C. 154(b) by 147 days.

(21) Appl. No.: 10/789,951

(22) Filed: Feb. 27, 2004

(65) Prior Publication Data

US 2004/0235342 A1 Nov. 25, 2004

Related U.S. Application Data

(60) Provisional application No. 60/450,385, filed on Feb. 27, 2003.

(51) Int. Cl.
*G05F 1/16* (2006.01)

(52) U.S. Cl. ..... 361/679; 361/685; 312/271; 312/223.1; 248/65

(58) Field of Classification Search ..... 361/679, 361/685, 724, 725; 312/223.1, 271, 223.3, 312/275; 248/65, 200, 205.1
See application file for complete search history.

(56) References Cited

U.S. PATENT DOCUMENTS 4,722,022 A * 1/1988 Myers et al. ..... 361/818
5,808,871 A * 9/1998 Rosecan et al. ..... 361/730
5,971,506 A * 10/1999 Dubin ..... 312/223.2
6,075,694 A * 6/2000 Mills et al. ..... 361/685

* cited by examiner

*Primary Examiner*—Yean-Hsi Chang
(74) *Attorney, Agent, or Firm*—The Webb Law Firm

(57) ABSTRACT

A bracket element for a prefabricated distribution device enclosure includes a body having a front surface, a rear surface and at least one side surface connecting the front surface to the rear surface. The bracket element includes a module opening extending through a portion of the front surface for at least partially receiving a communications module therein. The bracket element also includes an enclosure connection orifice arrangement of a plurality of enclosure connection orifices located on one of the side surface and/or the rear surface. An attachment mechanism is in operable communication with one or more of the enclosure connection orifices for securing the bracket element to a surface of the distribution device enclosure.

28 Claims, 6 Drawing Sheets

BRACKET ELEMENT FOR A DISTRIBUTION DEVICE ENCLOSURE

CROSS REFERENCE TO RELATED APPLICATIONS

This application claims the benefit of U.S. Provisional Patent Application No. 60/450,385, filed Feb. 27, 2003, which is hereby incorporated by reference in its entirety.

BACKGROUND OF THE INVENTION

1. Field of the Invention

The present invention relates generally to brackets and attachment devices and, specifically, to bracket elements and attachment devices for use in connection with prefabricated distribution device enclosures for housing electronic components and the like.

2. Description of Related Art

Electrical and communication components are widely used in various applications and industries. For example, communication networks are built and designed in homes, businesses, office buildings, etc. Similarly, all types of communication networks require some ability to transmit signals and electronic information from location to location. For example, cable television requires a cable, a telephone requires telephone lines, many personal computers require modem, communication or Ethernet lines, etc.

In both new construction and structure reconstruction, it is often desirable to "hide" the communication links, nodes and other junctures from plain view. For example, many users typically prefer to have the telecommunications and other lines in the wall space with outlets located at various positions and locations on the wall. This is typically more desirable than having wires on the floor and wound around the room, which is both unsightly and unsafe.

In the communications and hardware industry, there are many manufacturers of prefabricated distribution device boxes or enclosures. Typically, such boxes are sized so as to fit between studs and be attached thereto prior to finishing the walls. These boxes are typically screwed into or attached between two studs, which are spaced at industry-regulated positions. Further, such boxes often have a cover that can be unscrewed or hingedly opened in order to gain access inside the box.

Inside these distribution device boxes are located multiple electrical or electronic component modules having telecommunication or communication ports and outlets, often together with lighting indicators and a printed circuit board (PCB) for controlling the signals and electronic communication between the ports and incoming/outgoing communication lines. Again, as with the boxes, these modules are typically standard in size in the industry so that they can be attached to the interior of the distribution device enclosure regardless of the manufacturer.

In order to physically secure the module or modules into or within the box, a bracket element is required. However, the bracket element must be able to be attached to a portion of typically the rear surface of the box. Therefore, manufacturers provide multiple spaced and positioned box orifices at various locations on this rear surface. However, the hole configuration for use in connecting the bracket element is not standard and varies according to the manufacturer's choice and design. This means that the installer must understand the specific and varying manufacturer's hole configuration and ensure that he or she has the appropriate bracket elements for attaching the modules in the distribution device box.

SUMMARY OF THE INVENTION

It is, therefore, an object of the present invention to provide a bracket element for use in connection with a prefabricated distribution device enclosure that overcomes the deficiencies of the prior art. It is another object of the present invention to provide a bracket element for a prefabricated distribution device enclosure that is capable of being attached within various distribution device enclosures regardless of its unique attachment orifice configuration. It is yet another object of the present invention to provide a bracket element for a prefabricated distribution device enclosure that can be flushly mounted to the rear surface of the distribution device enclosure. It is a still further object of the present invention to provide a bracket element for a prefabricated distribution device enclosure that can be oriented in at least two flushly-mounted positions with respect to the rear surface of the distribution device enclosure.

The present invention is a bracket element for attaching one or more modules in a prefabricated distribution device enclosure, typically against the rear surface of the distribution device enclosure. The bracket element includes a body with a front surface, a rear surface and at least one side surface connecting the front surface and the rear surface. The bracket element also includes at least one, and typically multiple, module openings extending through at least a portion of the front surface for at least partially receiving a communications module therethrough. An enclosure connection orifice arrangement, including multiple enclosure connection orifices, is positioned on at least one of the side surface and the rear surface of the body, with the enclosure connection orifices extending through a surface of the body. At least one attachment mechanism is in operable communication with one or more of the enclosure connection orifices and used to secure the bracket element to a surface of the distribution device enclosure.

The present invention, both as to its construction and its method of operation, together with the additional objects and advantages thereof, will best be understood from the following description of exemplary embodiments when read in connection with the accompanying drawings.

BRIEF DESCRIPTION OF THE DRAWINGS

FIG. 1(*b*) is an edge view of the bracket element of FIG. 1 (*a*);

FIG. 1(*c*) is a side view of the bracket element of FIG. 1(*a*);

FIG. 1(*d*) is a top view of the bracket element of FIG. 1(*a*);

FIG. 1(*e*) is another side view of the bracket element of FIG. 1(*a*);

FIG. 1(*f*) is a bottom view of the bracket element of FIG. 1(*a*);

FIG. 2(*b*) is a perspective view of the attachment mechanism of FIG. 2(*a*);

FIG. 3(*b*) is a perspective view of a distribution device enclosure cover for use in connection with the distribution device enclosure of FIG. 3(*a*);

FIG. 3(*c*) is a front view of the cover of FIG. 3(*b*);

FIG. 3(*d*) is a side view of the cover of FIG. 3(*b*);

FIG. 3(*e*) is a rear view of the cover of FIG. 3(*b*);

FIG. 4(*b*) is a top view of the distribution device enclosure of FIG. 4(*a*);

FIG. 4(*c*) is a front view of the distribution device enclosure of FIG. 4(*a*);

FIG. 4(*d*) is a bottom view of the distribution device enclosure of FIG. 4(*a*);

FIG. 4(*e*) is a perspective view of the distribution device enclosure of FIG. 4(*a*);

FIG. 5(*b*) is a front view of a cover for the distribution device enclosure illustrated in FIG. 5(*a*);

FIG. 5*c* is a side view of the cover of FIG. 5(*b*);

FIG. 5*d* is a rear view of the cover of FIG. 5(*b*);

FIG. 5(*e*) is a perspective view of the cover of FIG. 5(*b*);

FIG. 6*b* is a front view of the distribution device enclosure illustrated in FIG. 5(*a*);

FIG. 6*c* is a top view of the distribution device enclosure illustrated in FIG. 5(*a*); and FIG. 6*d* is a side view of the distribution device enclosure illustrated in FIG. 5(*a*).

DESCRIPTION OF THE PREFERRED EMBODIMENTS

Figure 1:
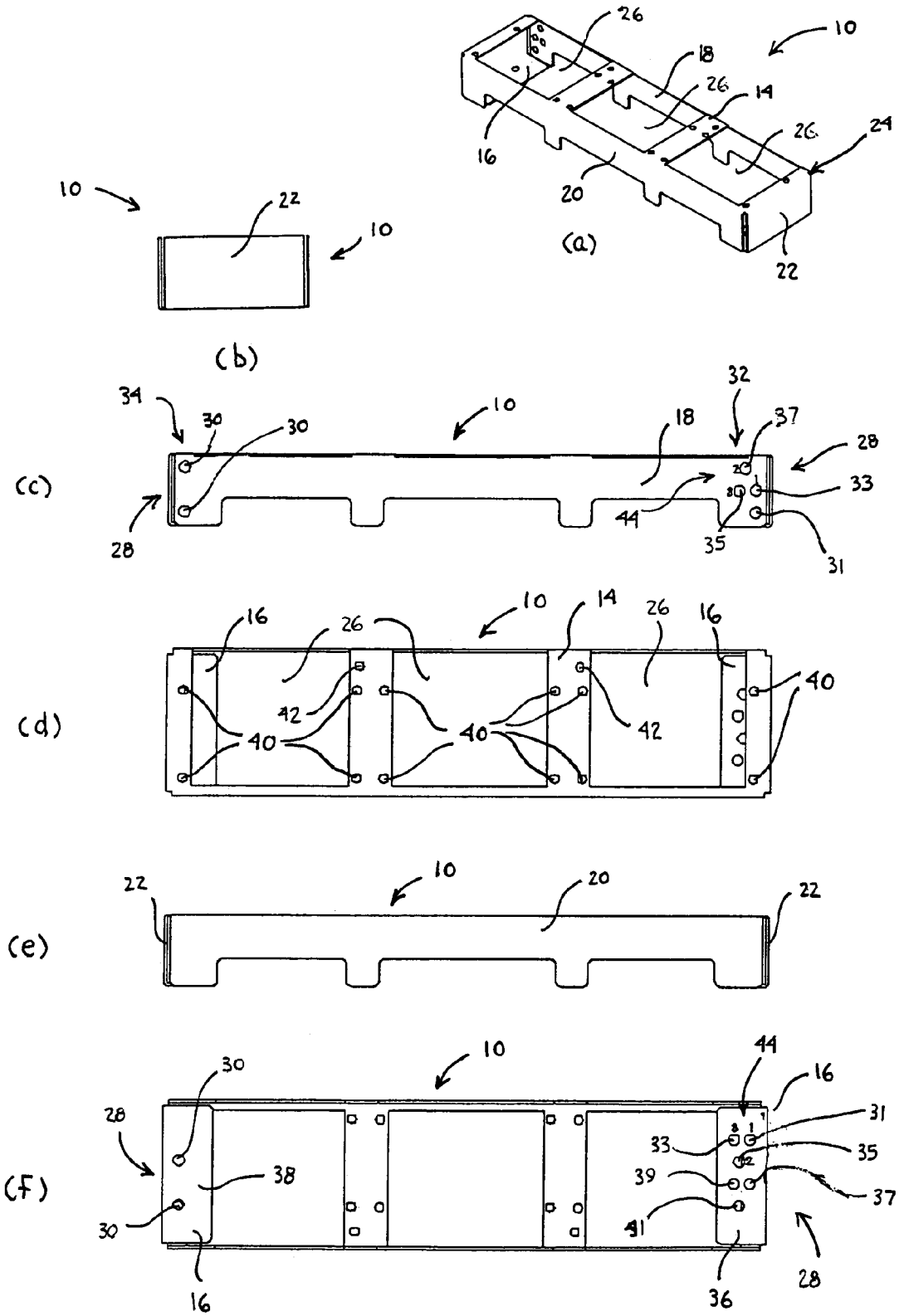
FIG. 1(*a*)is a perspective view of a bracket element according to the present invention.

The present invention is directed to a bracket element 10, as illustrated in FIGS. 1(*a*)–(*f*) for use in connection with a prefabricated distribution device enclosure 12, such as a residential structured wiring enclosure, as illustrated in FIGS. 3–6. The bracket element 10 includes a top surface 14, rear surface portions 16, a first side surface 18, a second side surface 20 and edge surfaces 22. This arrangement provides for a generally enclosure-like construction of the bracket element 10.

In a preferred and non-limiting embodiment, the bracket element 10 is manufactured from a metallic substrate and coated or painted with a specified layer or composition, which allows the substrate to attain desired properties, such as low flammability or inability to "spark." Typically, the bracket element 10 is stamped or cut out of a sheet of metal, cut into a specified shape and bent into the bracket element 10 illustrated in FIG. 1. However, the bracket element 10 may be manufactured from a metal, a semi-metal, a synthetic material, a plastic, a polymer, etc. This enclosure-like structure results in a body 24 having the surfaces as defined above. In another embodiment, it may also be preferred to bevel or round one or more of the edge surfaces and corners of the body 24 in order to reduce the chance of an installer cutting himself or herself on the body 24 edges.

The bracket element 10, and specifically the top surface 14 of the body 24, includes a module opening 26 extending through the top surface 14. Since a typical module includes multiple outlet ports and other projecting elements on its face, the module opening 26 is configured to allow at least a portion of the module, and typically these projecting elements, to extend through the module opening 26. Since these communication modules have a standard size in the industry, the module opening 26 is sized and shaped so as to accommodate any number of similarly-sized modules. In addition, while the bracket element 10 illustrated in FIG. 1 shows three module openings 26, it is of course envisioned that any number of module openings 26 can be manufactured. For example, it may be preferable to have only one or two module openings 26 extending through the top surface 14. The module opening 26 positioned in orientation with respect to the top surface 14 and the other module openings 26 are modifiable so as to allow greater flexibility in design.

As best seen in FIGS. 1(*c*) and 1(*f*), the bracket element 10 also includes at least one and typically multiple enclosure connection orifice arrangements 28. These enclosure connection orifice arrangements 28 are made up of one and typically multiple enclosure connection orifices 30, which are grouped and located on either the first side surface 18 and the second side surface 20, as well as on one or both of the rear surface portions 16. As seen in FIG. 1(*c*), one such enclosure connection orifice arrangement 28 is located on a first end 32 of the first side surface 18, and another enclosure connection orifice arrangement 28 is located on a second end 34 of the first side surface 18. In this preferred and non-limiting embodiment, both the enclosure connection orifice arrangement 28 on the first end 32 and the enclosure connection orifice arrangement 28 on the second end 34 include multiple enclosure connection orifices 30, which extend through the first side surface 18.

In this preferred and non-limiting embodiment, the enclosure connection orifice arrangement 28 on the first end 32 of the first side surface 18 includes a first enclosure connection orifice 31, a second enclosure connection orifice 33, a third enclosure connection orifice 35 and a fourth enclosure connection orifice 37. The first enclosure connection orifice 31 and the second enclosure connection orifice 33 are vertically aligned with each other. The third enclosure connection orifice 35 and the fourth enclosure connection orifice 37 are spaced and/or offset from the first and second enclosure connection orifices (31, 33). This specific arrangement allows for variance in the ability to connect the bracket element 10 to the distribution device enclosure 12. The enclosure connection orifice arrangement 28 on the second end 34 of the first side surface 18 includes two vertically aligned and spaced enclosure connection orifices 30. At least one, and typically multiple enclosure connection orifices (30, 31, 33, 35, 37) of one or both of the enclosure connection orifice arrangements 28 are used to connect the bracket element 10 to the distribution device enclosure 12.

A similar arrangement may be located on the rear surface portion 16 of the body 24. As seen in FIG. 1(*f*), the enclosure connection orifice arrangement 28 on a first rear portion 36 includes a first set of enclosure connection orifices 30 and a second set of enclosure connection orifices 30. Specifically, the first set of enclosure connection orifices 30 includes a first enclosure connection orifice 31 horizontally aligned with a second enclosure connection orifice 33, and a third enclosure connection orifice 35 is vertically spaced from the first and second enclosure connection orifices (31, 33). The second set of enclosure connection orifices 30 includes a fourth enclosure connection orifice 37 horizontally aligned with a fifth enclosure connection orifice 39, and a sixth enclosure connection orifice 41 vertically spaced from the fourth and fifth enclosure connection orifices (37, 39). Further, the second set of enclosure connection orifices 30 is vertically spaced from the first set of enclosure connection orifices 30. On a second rear portion 38, like the second end 34 of the first side surface 18, the enclosure connection orifice arrangement 28 includes two vertically spaced and aligned enclosure connection orifices 30. As with the enclosure connection orifice arrangements 28 described in connection with the first side surface 18, the enclosure connection orifice arrangements 28 on the rear surface portions 16 allow an installer to connect the bracket element 10 to various prefabricated distribution device enclosures 12.

As seen in FIG. 1(*d*), the body 24 of the bracket element 10 also includes multiple spaced module connection orifices 40 extending through the top surface 14. As best seen in FIG. 1(*d*), a pair of module connection orifices 40 is located on either side of a respective module opening 26 and configured to align with connection orifices on the communications module. Each module opening 26 includes two pairs, or a set of four module connection orifices 40 for use in connection with attaching a communications module. Since typically the communications and network equipment that is attached to the module is done so by hard wires, it is often undesirable to allow these wires to dangle and hang in disarray in the distribution device enclosure 12. Therefore, the bracket element 10 also includes one and typically multiple wire clip orifices 42. These wire clip orifices 42 are positioned adjacent or near the module opening 26 and wires connected to the module can be bundled, clipped and held by inserting and fastening the clip, or similar attachment mechanism, through a respective wire clip orifice 42.

In order to facilitate easier installation, the bracket element 10 may include orifice labels 44 positioned adjacent one or more of the enclosure connection orifices 30. Like labels should be used for the enclosure connection orifices 30 that are appropriately aligned for connection to the distribution device enclosure 12. As seen in FIGS. 1(*c*) and 1(*f*), a simple number could be placed near the enclosure connection orifice (30, 31, 33, 35, 37, 39, 41), and the installer may be instructed as to which number should be used for installation in a particular prefabricated distribution device enclosure 12. The label may be a symbol, a number, a letter, a representation, an identifying mark or any combination thereof. In addition, the label 44 may be etched into a surface of the body 24, applied to a surface of the body 24 and/or adhesively joined with a surface of the body 24. The label 44 may correspond to and assist an installer in identifying an entity, a manufacturer, a company, a name, an identification, etc.

Figure 4:
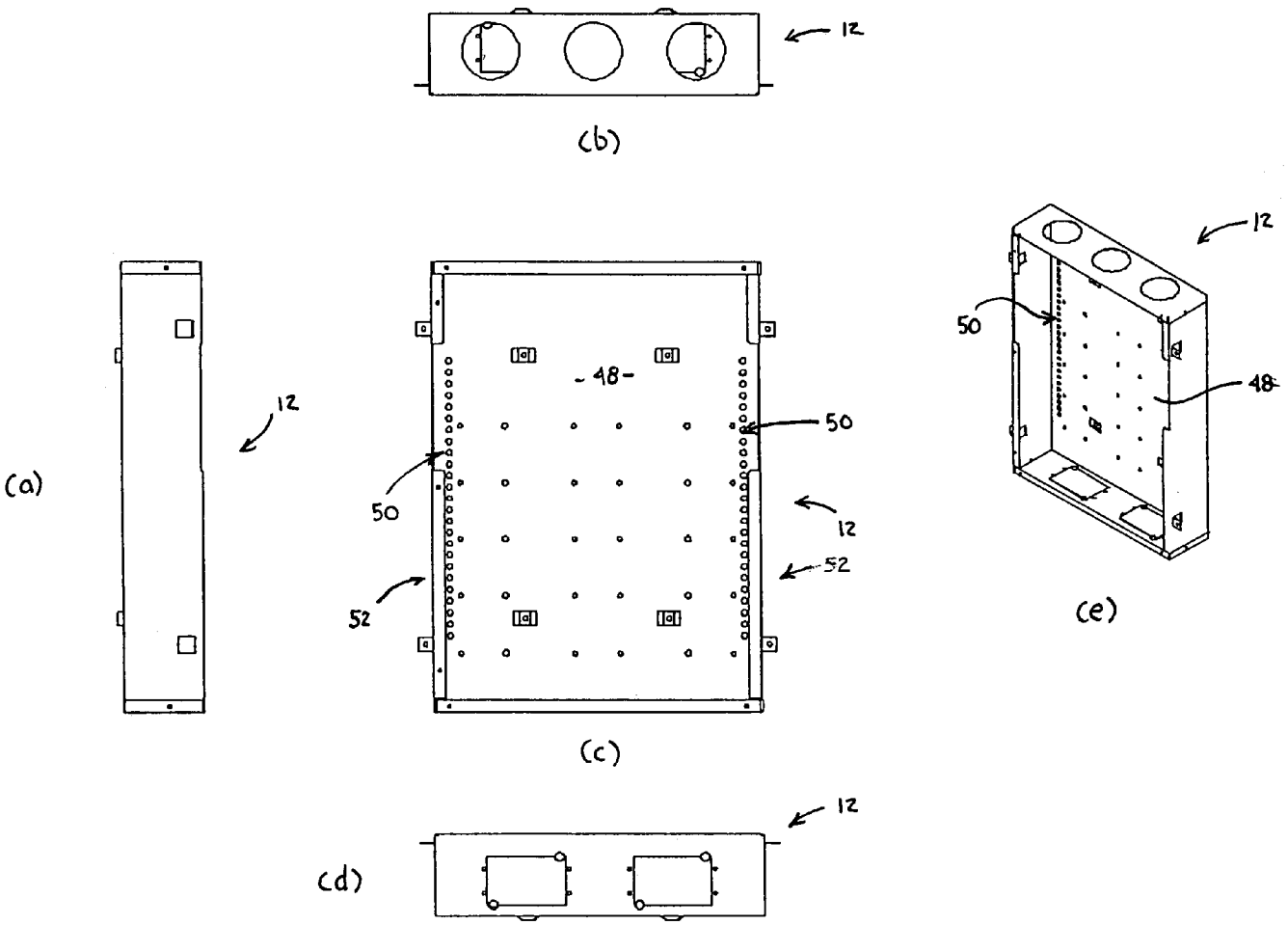
FIG. 4(*a*)is a side view of a distribution device enclosure.
Figure 5:
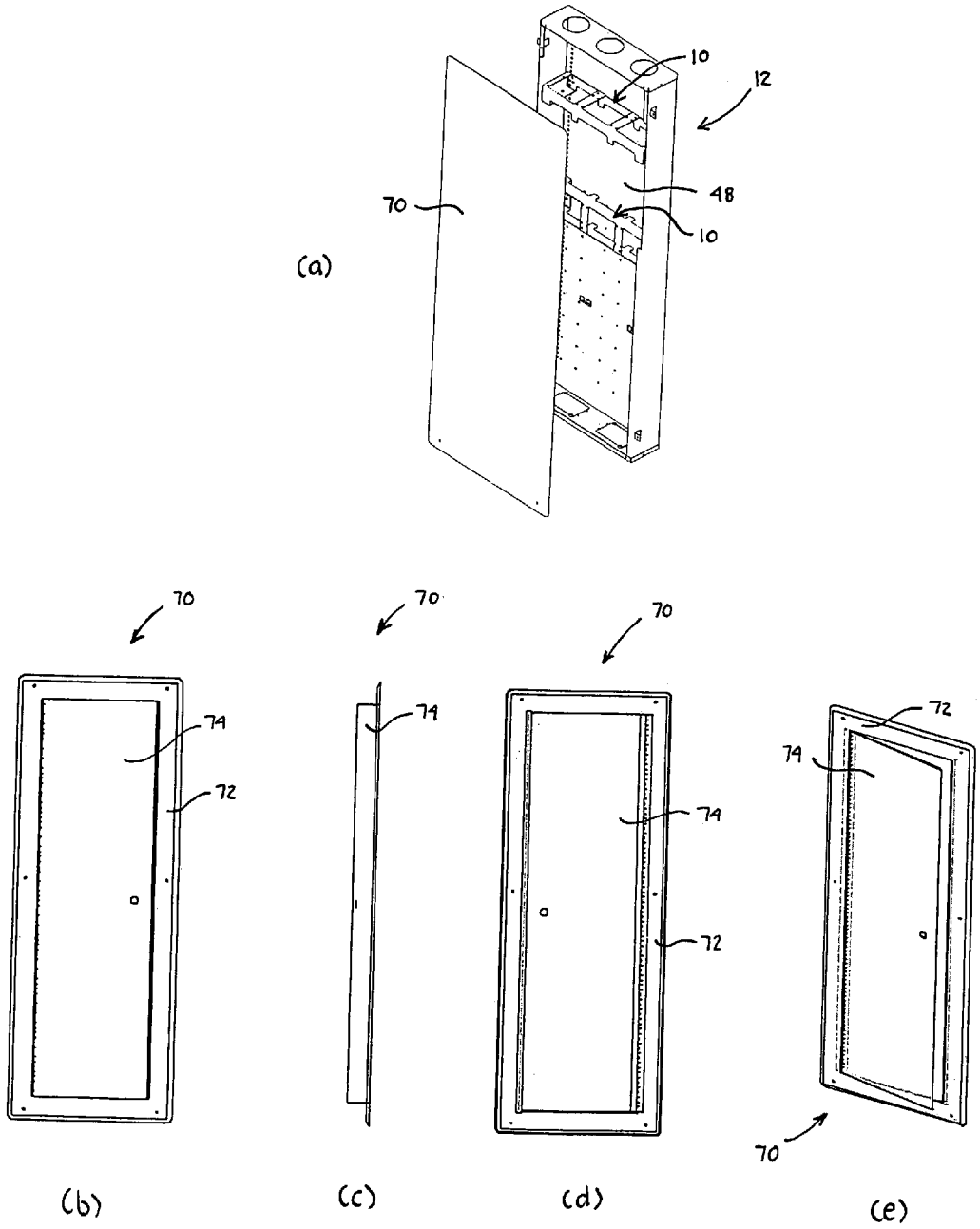
FIG. 5(*a*)is a perspective view of multiple bracket elements of FIG. 1(*a*)installed in a distribution device enclosure.

In order to attach the bracket element 10 to the distribution device enclosure 12, and typically a rear inside wall surface 48 of the distribution device enclosure 12, an attachment mechanism 46 is used. Typically, the distribution device enclosure 12 includes multiple bracket attachment orifices 50 specifically located and extending through the rear inside wall surface 48 of the distribution device enclosure 12. As seen in FIGS. 4(*c*) and 6(*b*), two such distribution device enclosures 12 are illustrated, and each distribution device enclosure 12 includes multiple bracket attachment orifices 50 positioned along and spaced apart along edge areas 52 of the rear inside surface wall 48. The location and position of the bracket attachment orifices 50 shown in FIG. 4(*c*) are only one of many and variable desired positions for the bracket attachment orifices 50. As discussed above, various manufacturers of distribution device enclosures 12 will space, position and align the bracket attachment orifices 50 differently, which lends itself to the use of the labels 44 of the presently-invented bracket element 10.

Figure 2:
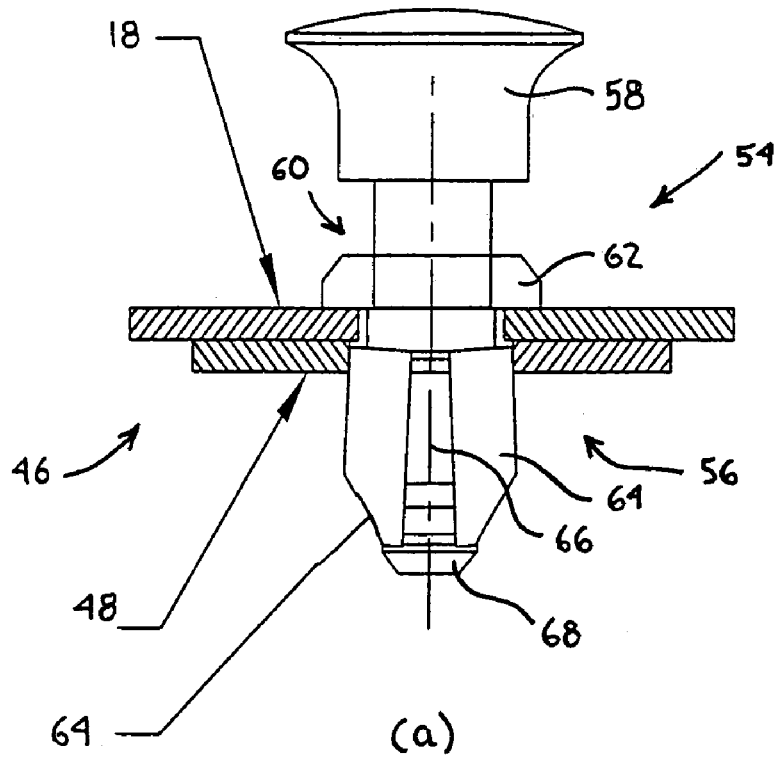
FIG. 2(*a*)is a side partial sectional view of an attachment mechanism for use in connection with the bracket element according to the present invention.
Figure 2:
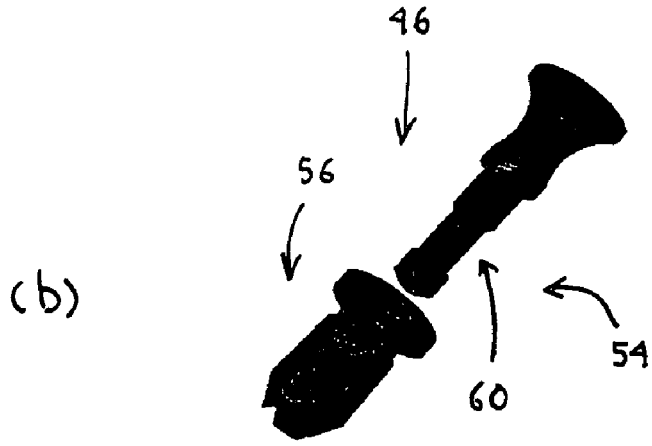

Returning to FIG. 2, the attachment mechanism 46 includes a plunger element 54 and grommet element 56. The plunger element 54 is sized and shaped so as to mate with and connect with the grommet element 56. Specifically, the plunger element 54 includes a top surface 58 and an insertion portion 60. The grommet element 56 includes a rim portion 62, multiple flap portions 64 and an insertion conduit 66 extending through the rim portion 62 and the flap portions 64. These flap portions 64 are flexible and able to expand and contract with the appropriate force.

In operation, a specific enclosure connection orifice 30 is aligned with a bracket attachment orifice 50 and the grommet element 56 is inserted therethrough. As the grommet element 56 is being inserted, the flap portions 64 contract and are pushed through the enclosure connection orifice 30 and the bracket attachment orifice 50, and the grommet element 56 is further moved until the rim portion 62 abuts the area around the enclosure connection orifice 30. Due to the size and shape of the rim portion 62 and flap portions 64, the grommet element 56 is removeably positioned through the enclosure connection orifice 30 and the bracket attachment orifice 50.

In order to lock the bracket element 10 to the rear inside wall surface 48 of the distribution device enclosure 12, the plunger element 54 is then inserted through the insertion conduit 66 of the grommet element 56. Specifically, the top surface 58 is pushed and forces the insertion portion 60 into the insertion conduit 66 until an end rim 68, located at the end of the plunger element 54, extends fully through and by the flap portions 64. Due to the flexible nature of the flap portions 64, once the end rim 68 has passed through the flap portions 64, the flap portions 64 contract and the end rim 68, together with the insertion portion 60, ensure that the grommet element 56 cannot be removed. In this manner, the bracket element 10 is attached to the distribution device enclosure 12, and this process can be repeated for multiple enclosure connection orifices 30 when aligned with corresponding bracket attachment orifices 50. This attachment mechanism 46 can also be used for attaching the module in the module opening 26. Specifically, the grommet element 56 could be inserted through the module connection orifices 40 and further through connection orifices on the module face. Again, the plunger element 54 is then inserted in the grommet element 56 until the rim portion 62 abuts the area around the module connection orifice 40. In this manner, the module is attached in the module opening 26 and appropriately secured in the bracket element 10.

Figure 3:
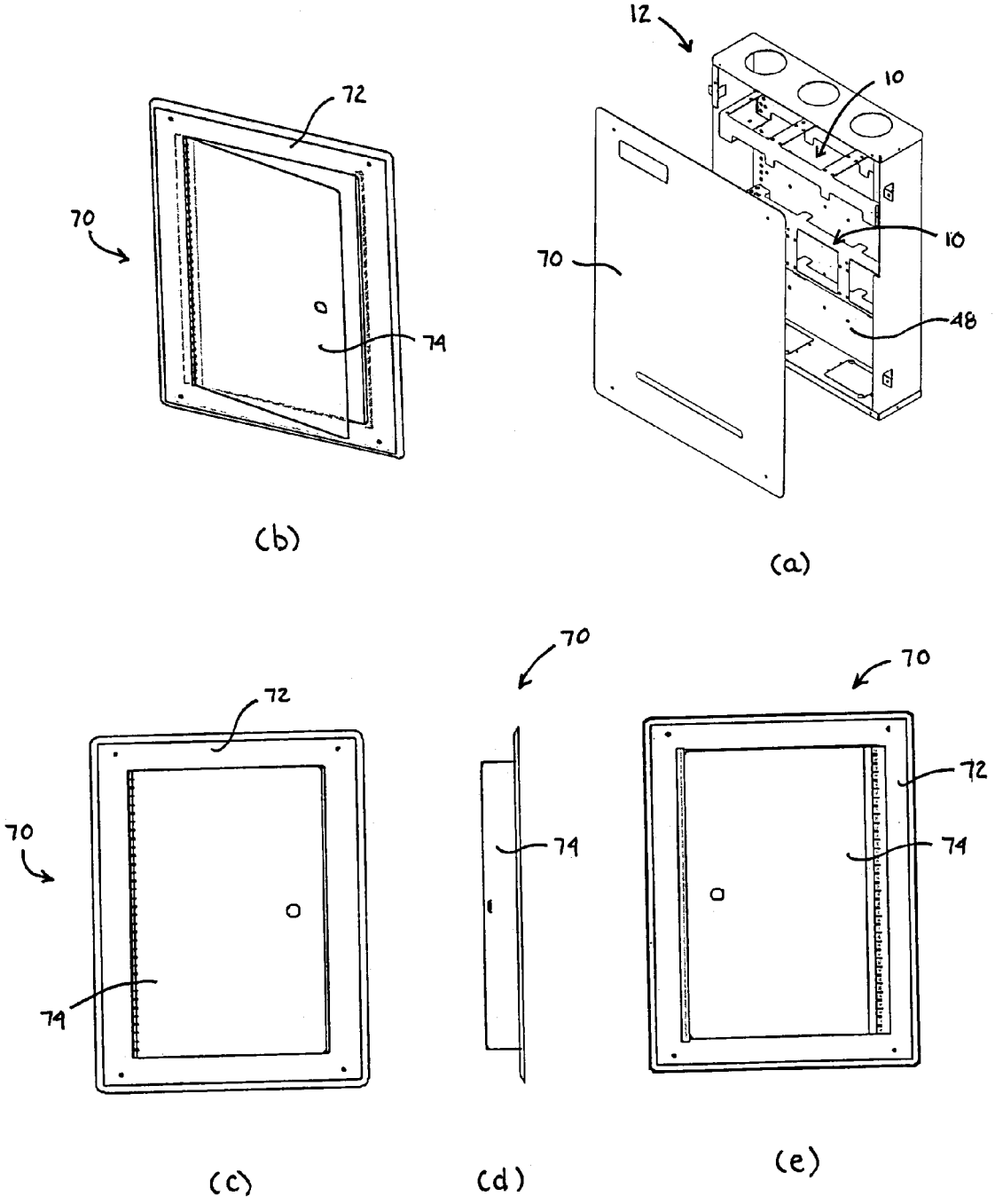
FIG. 3(*a*)is a perspective view of multiple bracket elements of FIG. 1(*a*)installed in a distribution device enclosure.

Since the enclosure connection orifice arrangements 28 are located on both the first side surface 18 and the rear surface portion 16, the bracket element 10 can be attached to the rear inside wall surface 48 of the distribution device enclosure 12 with either the first side surface 18 abutting the rear inside wall surface 48 or, alternatively, the rear surface portion 16 abutting the rear inside wall surface 48. This alternate arrangement is illustrated in FIGS. 3(*a*) and 5(*a*)as installed with two different distribution device enclosures 12. In this manner, the bracket element 10 is a flush-mount bracket and can be used in connection with a variety of distribution device enclosures 12 having a variety of bracket attachment orifices 50.

Once the bracket elements 10 are installed in the distribution device enclosure 12, with or without modules installed in the bracket element 10, the distribution device enclosure 12 is installed in one's dwelling or structure. In order to provide appropriate access to the distribution device enclosure 12, the distribution device enclosure 12 also includes a distribution device enclosure cover 70, which may be directly attached to the distribution device enclosure 12 as shown in FIGS. 3(*a*)and 5(*a*). However, as seen in FIGS. 3(*b*)–(*e*) in various views, the distribution device enclosure cover 70 may also include an outer rim area 72 with a hingeable or openable door 74 located within the outer rim area 72. A distribution device enclosure cover 70 is typically used with any distribution device enclosure 12, as seen in use in connection with a different distribution device enclosure 12 in FIG. 5(*a*). Similarly, as seen in various views in FIGS. 5(*b*)–(*e*), any size and shape of distribution device enclosure 12 can use the outer rim area 72 and door 74 arrangement to allow easy access to the distribution device enclosure 12.

Figure 6:
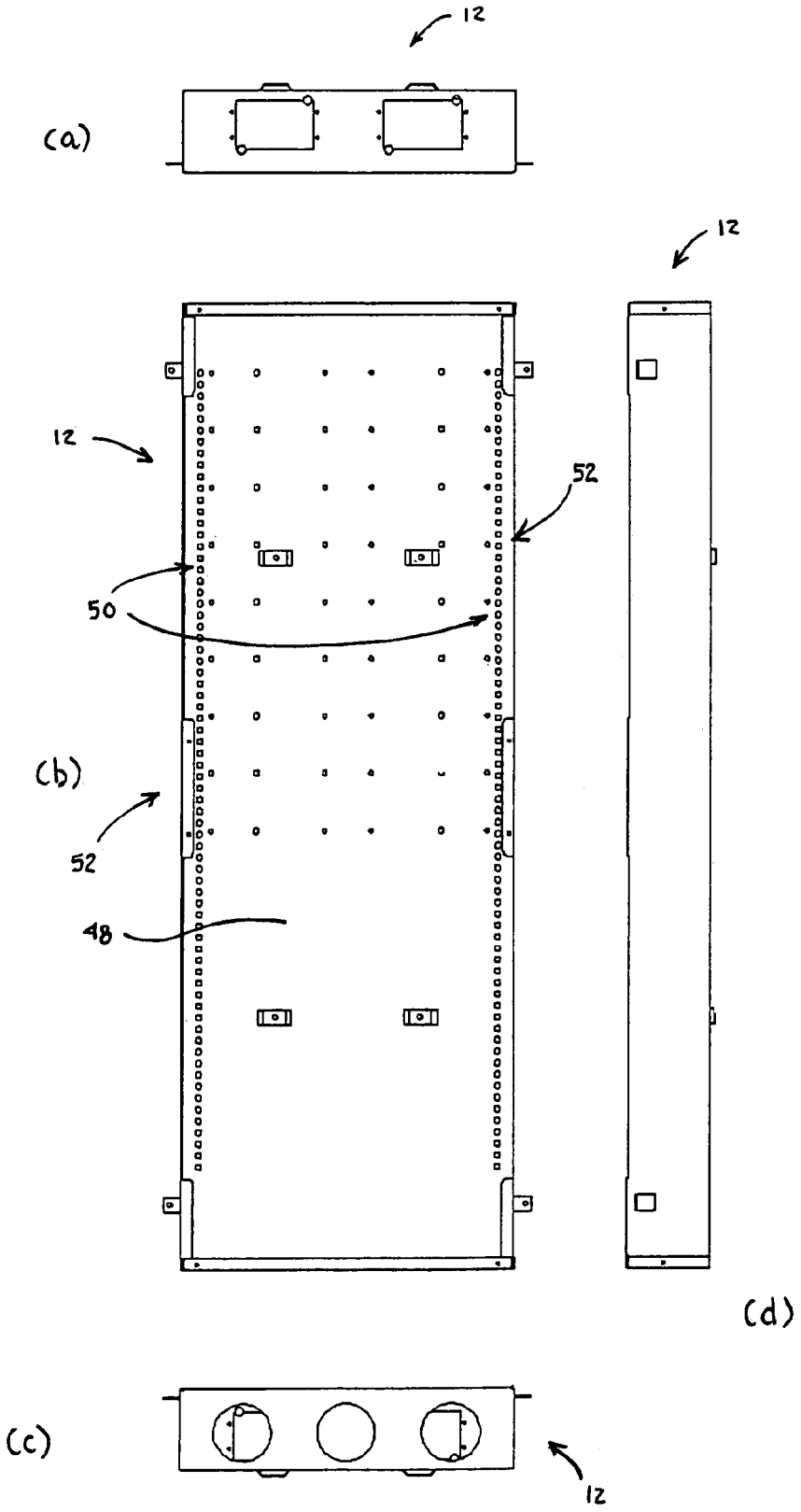
FIG. 6(*a*)is a bottom view of the distribution device enclosure illustrated in FIG. 5(*a*)

As seen in FIGS. 4 and 6, the bracket attachment orifices 50 are linearly arranged and extend in a straight line along the edge areas 52 of the rear inside wall surface 48. It is envisioned that the installer may be instructed, whether by manual or otherwise, that when using this particular distribution device enclosure 12 or this particular manufacturer's distribution device enclosure 12, the installer should attach the bracket element 10 to the rear inside wall surface 48 of the distribution device enclosure 12 via a specified set of orifice labels 44. For example, when attaching the bracket element 10 to the distribution device enclosure 12 illustrated in FIGS. 4 and 6, the installer should use the enclosure connection orifices 30 having the label "1" in connection with the enclosure connection orifice arrangement 28 located on the first end 32 of the first side surface 18 or the enclosure connection orifice arrangement 28 located on the first rear portion 36. Additionally, the bracket element 10 may be further attached using the enclosure connection orifice arrangements 28 located on the second end 34 of the first side surface 18 or, alternatively, the second rear portion 38. While it may be feasible to use the attachment mechanism 46 with respect to only a single enclosure connection orifice 30 in a particular enclosure connection orifice arrangement 28, it is desirable to connect the bracket element 10 by using at least one enclosure connection orifice 30 on the first end 32 of the first side surface 18 (or the first rear portion 36) and the second end 34 of the first side surface 18 (or the second rear portion 38), depending upon the orientation of the bracket element 10.

The bracket element 10 and the module openings 26 can be manufactured to specific dimensions. For example, in the field of residential telecommunications cabling applications, there is an industry standard and a bend radius equation. The standard states that 100 ohm UTP bend radii shall be no less than four times the cable diameter. In addition to phone/networking wire, the standard defines bend radius requirements for coaxial cable. This standard requires that the cable shall not be less than ten times the outside diameter cable when dressed (inside the distribution device enclosure 12). Therefore, the bracket element 10 and module openings 26 can meet these standards, whether flushly mounted on the first side surface 18 or the rear portions (36, 38).

Overall, the present invention provides a bracket element 10 that can be used in connection with multiple and various prefabricated distribution device enclosures 12. The bracket element 10 can be flushly mounted to the rear inside wall surface 48 of the distribution device enclosure 12, with either the first side surface 18 or the rear surface portion 16 abutting the rear inside wall surface 48. Further, the use of the enclosure connection orifice arrangement 28 with multiple offset and spaced enclosure connection orifices 30 allows for greater flexibility in installing the bracket element 10 in different manufacturers' distribution device enclosures 12. In addition, through instruction in using the orifice labels 44, the installer can easily locate and align the appropriate enclosure connection orifices 30 with the corresponding bracket attachment orifices 50.

This invention has been described with reference to the preferred embodiments. Obvious modifications and alterations will occur to others upon reading and understanding the preceding detailed description. It is intended that the invention be construed as including all such modifications and alterations.

The invention claimed is:

1. A bracket element for a prefabricated distribution device enclosure, comprising:

a body having a top surface, a rear surface and at least two side surfaces connecting the top surface to the rear surface;

at least one module opening extending through at least a portion of the top surface and configured to at least partially receive a communications module therethrough;

at least one enclosure connection orifice arrangement comprising a plurality of enclosure connection orifices positioned on and extending through at least one of the surfaces of the body; and at least one attachment mechanism configured to secure the bracket element to a surface of the distribution device enclosure by engagement with at least one of the plurality of enclosure connection orifices;

wherein the at least one attachment mechanism further comprises a plunger element and a grommet element, the plunger element configured to engage with the grommet element.

2. The bracket element of claim 1, wherein the surface through which the plurality of enclosure connections extends is at least one of the rear surface and at least one of the two side surfaces.

3. The bracket element of claim 1, wherein the body of the bracket element is manufactured from at least one of a metal, a semi-metal, an alloy, an synthetic material, a plastic and a polymer.

4. The bracket element of claim 1, wherein the body of the bracket element is at least partially coated with a material on at least one of the surfaces.

5. The bracket element of claim 1, wherein at least one corner of the body of the bracket element is at least one of blunted, rounded, dulled, ground and beveled.

6. The bracket element of claim 1, wherein the module opening is sized and shaped so as to allow at least one communications module projecting element to extend therethrough.

7. The bracket element of claim 1, further comprising a plurality of module openings extending through at least a portion of the front surface and configured to at least partially receive a respective communications module therethrough.

8. The bracket element of claim 1, further comprising a plurality of enclosure connection orifice arrangements, wherein at least one of the plurality of enclosure connection orifice arrangements is positioned on at least one of:

(i) a first end of at least one of the side surfaces;

(ii) a second end of at least one of the side surfaces;

(iii) a first end of the rear surface; and (iv) a second end of the rear surface.

9. The bracket element of claim 1, further comprising a first enclosure connection orifice arrangement positioned on one of a first end of one of the side surfaces and a first end of the rear surface, and a second enclosure connection orifice arrangement positioned on one of a second end of one of the side surfaces and a second end of the rear surface.

10. The bracket element of claim 9, wherein the plurality of enclosure connection orifices of the first enclosure connection orifice arrangement comprises four enclosure connection orifices, with a first enclosure connection orifice substantially vertically aligned with a second enclosure connection orifice and a third and fourth enclosure connection orifice spaced from the second enclosure connection orifice.

11. The bracket element of claim 9, wherein the plurality of enclosure connection orifices of the second enclosure connection orifice arrangement comprises two enclosure connection orifices, with a first enclosure connection orifice substantially vertically aligned with a second enclosure connection orifice.

12. The bracket element of claim 9, wherein the plurality of enclosure connection orifices of the first enclosure connection orifice arrangement comprises a first set of three enclosure connection orifices, with a first enclosure connection orifice substantially horizontally aligned with a second enclosure connection orifice and a third enclosure connection orifice substantially vertically spaced from the first and second enclosure connection orifice, and a second set of three enclosure connection orifices, with a fourth enclosure connection orifice substantially horizontally aligned with a fifth enclosure connection orifice and a sixth enclosure connection orifice vertically spaced from the fourth and fifth enclosure connection orifice, wherein the second set of enclosure connection orifices is substantially vertically spaced from the first set of enclosure connection orifices.

13. The bracket element of claim 12, further comprising a plurality of wire clip orifices extending through the top surface of the body of the bracket element.

14. The bracket element of claim 13, further comprising a plurality of module connection orifices extending through a top surface of the body of the bracket element.

15. The bracket element of claim 1, further comprising at least one wire clip orifice extending through a surface of the body of the bracket element and positioned in a spaced relationship with the at least one module opening, the wire clip orifice configured to receive a clip element therethrough, the clip element configured to secure at least one wire.

16. The bracket element of claim 1, further comprising at least one module connection orifice extending through a surface of the body of the bracket element and positioned in a spaced relationship with the at least one module opening, the module connection orifice configured to receive an attachment mechanism therethrough for connecting a communications module to the bracket element.

17. The bracket element of claim 1, further comprising at least one label positioned substantially adjacent at least one of the plurality of enclosure connection orifices and configured to aid a user in identifying the at least one of the plurality of enclosure connection orifices.

18. The bracket element of claim 17, wherein the label is at least one of a symbol, a number, a letter, a representation and an identifying mark.

19. The bracket element of claim 17, wherein the label is at least one of etched in a surface of the body, applied to a surface of the body and adhesively joined with a surface of the body.

20. The bracket element of claim 17, wherein the label corresponds to at least one of an entity, a manufacturer, a company, a name and an identification.

21. The bracket element of claim 1, wherein the bracket element is removably attachable to a rear surface of the distribution device enclosure through insertion of the attachment mechanism through at least one enclosure connection orifice and further through a corresponding at least one bracket attachment orifice.

22. The bracket element of claim 21, wherein the rear surface of the bracket element is removably attachable to a rear surface of the distribution device enclosure through insertion of the attachment mechanism through at least one enclosure connection orifice and further through a corresponding at least one bracket attachment orifice.

23. The bracket element of claim 1, wherein the plunger element includes a top surface and an insertion portion, and the grommet element includes a rim portion, at least one flap portion and an insertion conduit extending through the rim portion and the at least one flap portion.

24. The bracket element of claim 23, wherein, in operation, an enclosure connection orifice is aligned with a corresponding bracket attachment orifice, the grommet element is inserted therethrough until the rim portion abuts an area around the enclosure connection orifice, and the plunger element is inserted through the insertion conduit of the grommet element.

25. The bracket element of claim 1, wherein at least one side surface of the bracket element is removably attachable to a rear surface of the distribution device enclosure through insertion of the attachment mechanism through at least one enclosure connection orifice and further through a corresponding at least one bracket attachment orifice.

26. The bracket element of claim 1, wherein at least one surface of the body of the bracket element is configured to abut and be flushly mounted against a surface of the distribution device enclosure.

27. A bracket element for a prefabricated distribution device enclosure, comprising:

a body having a top surface, a rear surface and at least two side surfaces connecting the top surface to the rear surface;

a plurality of module openings extending through at least a portion of the top surface and configured to at least partially receive a respective communications module therethrough;

a first enclosure connection orifice arrangement comprising a plurality of enclosure connection orifices positioned on and extending through one of a first end of a side surface and a first end of a rear surface, and a second enclosure connection orifice arrangement comprising a plurality of enclosure connection orifices positioned on and extending through one of a second end of a side surface and a second end of a rear surface; and at least one attachment mechanism configured to secure the bracket element to a surface of the distribution device enclosure by engagement with at least one of the plurality of enclosure connection orifices;

wherein the at least one attachment mechanism further comprises a plunger element and a grommet element, the plunger element configured to engage with the grommet element.

28. A method of mounting a bracket element to a distribution device enclosure, comprising the steps of:

providing a bracket element with a body having a top surface, a rear surface and at least two side surfaces connecting the top surface to the rear surface; at least one module opening extending through at least a portion of the top surface for at least partially receiving a communications module therethrough; and at least one enclosure connection orifice arrangement comprising a plurality of enclosure connection orifices positioned on and extending through at least one of the surfaces of the body; and attaching the bracket element to a surface of the distribution device enclosure by engaging an attachment mechanism with at least one of the plurality of enclosure connection orifices;

wherein the attachment mechanism further comprises a plunger element and a grommet element, the plunger element configured to engage with the grommet element.

* * * * *